US005182437A

United States Patent [19]

Schmid et al.

[11] Patent Number: 5,182,437

[45] Date of Patent: Jan. 26, 1993

[54] FLAME-TYPE HEATER PLUG FOR AN AIR-COMPRESSION FUEL-INJECTION INTERNAL-COMBUSTION ENGINE

[75] Inventors: Friedrich Schmid; Peter Joppig, both of Korb; Roland Klak, Ostfildern, all of Fed. Rep. of Germany

[73] Assignee: Mercedes-Benz AG, Fed. Rep. of Germany

[21] Appl. No.: 658,676

[22] Filed: Feb. 21, 1991

[30] Foreign Application Priority Data

Mar. 29, 1990 [DE] Fed. Rep. of Germany ..... 4010093

[51] Int. Cl.[5] ..... H05B 3/00; F23Q 7/00; F02P 19/02

[52] U.S. Cl. ..... 219/270; 123/145 A; 123/179.21; 123/179.6; 361/264; 431/208

[58] Field of Search ..... 219/260–270; 361/264–266; 431/208; 123/145 R, 145 A, 179 H, 549, 557, 297, 179.21, 179.6

[56] References Cited

U.S. PATENT DOCUMENTS

| | | | |
|---|---|---|---|
| 3,630,184 | 12/1971 | Wolf et al. | 123/145 A |
| 3,689,195 | 9/1972 | Beesch et al. | 123/145 A X |
| 3,718,425 | 2/1973 | Weyl et al. | 123/145 A X |
| 4,459,948 | 7/1984 | Bauer | 123/145 A |

FOREIGN PATENT DOCUMENTS

| | | |
|---|---|---|
| 1957954 | 3/1967 | Fed. Rep. of Germany . |
| 1903999 | 8/1970 | Fed. Rep. of Germany . |
| 7133650 | 2/1973 | Fed. Rep. of Germany . |
| 3301559 | 7/1984 | Fed. Rep. of Germany . |
| 3309133 | 9/1984 | Fed. Rep. of Germany . |
| 1329533 | 9/1973 | United Kingdom . |

*Primary Examiner*—Anthony Bartis
*Attorney, Agent, or Firm*—Evenson, Wands, Edwards, Lenahan & McKeown

[57] ABSTRACT

A flame-type heater plug for an internal combustion engine includes a plug housing having a proportioning insert for the fuel supply, a heater bar secured at one end in the plug housing with a free end extending outwardly of the plug housing, and an evaporation tube extending along a substantial length of the plug housing from the proportioning insert and surrounding the heating bar to form an annular interspace therebetween. The free end of the heater bar extends from the evaporator tube and is surrounded by a flame tube including passage orifices for passage of intake air into the interior of the flame tube. A helical swirl channel on the outer surface of the heating bar in the plug housing forms a fuel connection between the proportioning insert and the evaporator tube opening into the annular interspace. The passage orifices may be provided with deflectors to prevent direct contact of the heating bar by the air flowing therethrough.

12 Claims, 2 Drawing Sheets

FLAME-TYPE HEATER PLUG FOR AN AIR-COMPRESSION FUEL-INJECTION INTERNAL-COMBUSTION ENGINE

BACKGROUND AND SUMMARY OF THE INVENTION

The invention relates to a flame-type heater plug for an air-compression fuel-injection internal-combustion engine.

Under specific conditions, during starting the fuelinjection internal-combustion engines which work on the auto-ignition principle require starting aids in order to raise the final compression temperatures to values above the auto-ignition temperature.

Known flame-type heater plugs (FIG. 8) used as a starting aid during the starting operation consist essentially of a plug housing with a flame tube, a proportioning insert, a heating bar and an evaporator tube surrounding the heating bar. The fuel supplied via the proportioning insert passes into an annular interspace between the heating bar and evaporator tube and from there flows into the flame tube where it mixes with the inflowing air.

In designs of this type, it has been shown that the fuel introduced is not always evaporated sufficiently or is evaporated only partially, thus impairing the ignition of the fuel.

An object on which the invention is based is, by means of simple constructional variations on the flame-type heater plug referred to above, to prepare the fuel in such a way that it experiences the best possible evaporation and forms an ignitable mixture with the air penetrating into the flame tube.

The present invention achieves this object by providing an arrangement wherein a fuel connection includes a helical swirl channel opening into the annular interspace and located between the plug housing and the heating bar.

The special fuel connection between the proportioning insert and the evaporator tube ensures a substantially better evaporation of the fuel in the narrow helical swirl channel, from which the fuel emerges swirling and, accelerated by the annular interspace, enters the flame tube and there mixes with the inflowing air to form the best possible fuel/air mixture.

Other objects, advantages and novel features of the present invention will become apparent from the following detailed description of the invention when considered in conjunction with the accompanying drawings.

DETAILED DESCRIPTION OF THE DRAWINGS

Figure 1:
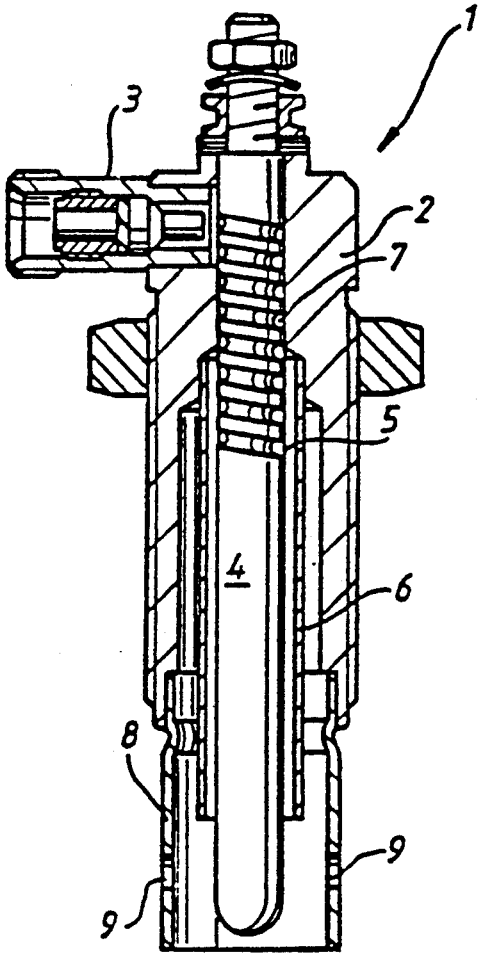
FIG. 1 is a schematic part sectional view of a flame-type heater plug, constructed according to a preferred embodiment of the invention.

The flame-type heater plug 1 illustrated in FIG. 1 is designed for use in an internal-combustion engine with air compression and auto-ignition. Heater plug 1 includes a plug housing 2 with a proportioning insert 3, a heating bar 4, and an evaporator tube 6 surrounding the latter to form an annular interspace 5. The upper end of this evaporator tube 6 is arranged at a distance from the proportioning insert 3, the plug housing 2 being so drawn in in this region that it is connected sealingly to the heating bar 4. For the fuel connection from the proportioning insert 3 to the annular interspace 5 there is a helical swirl channel 7 on the heating bar 4, through which swirl channel the fuel enters the annular interspace 5 swirling.

The free end of the heating bar 4 projects from the evaporator tube 6 and is shielded by means of a cylindrically designed flame tube 8 which is connected to the plug housing 2 and which is equipped with passage orifices 9 for the inflowing air.

So that the heating bar 4 is not directly exposed to the inflowing air, according to FIGS. 2 to 5 there is arranged between the flame tube, 8A, 8B, 8C and the heating bar 4, level with the passage orifices 9, an annular air deflector 10A, 10B, 10C which is retained by means of webs 11 (FIGS. 2 and 5) fastened to the flame tube 8, 8A, 8B, 8C below the passage orifices 9.

The air flowing into the interior of the flame-type heater plug 1 is thus deflected upwards and downwards.

Figure 3:
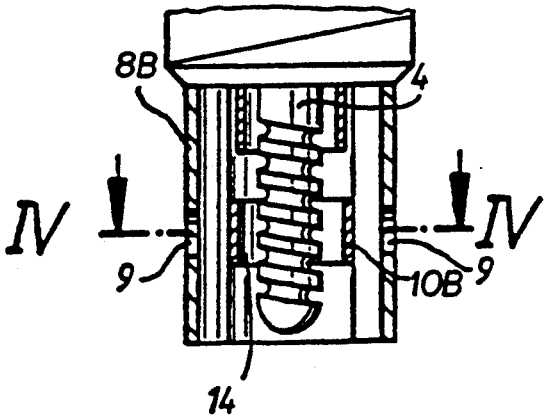
FIG. 3 shows another embodiment with a star-shaped flame tube with an air deflector.
Figure 4:
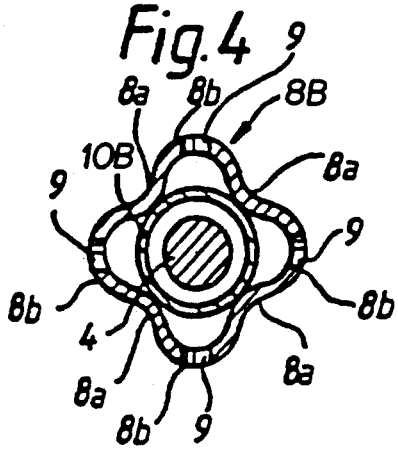
FIG. 4 shows the flame tube along the line IV—IV in FIG. 4.

FIGS. 3 and 4 illustrate an exemplary embodiment, in which the flame tube 8B is not of cylindrical, but of star-shaped design. The air deflector 10B is connected firmly to the indentations **8*a*, while the projections 8*b* have the passage orifices 9. As a result of the special design of the flame tube 8B, the air inside the flame-type heater plug 1 experiences high turbulence, and outside this plug 1** an improvement of the fuel/air mixture is obtained.

Figure 2:
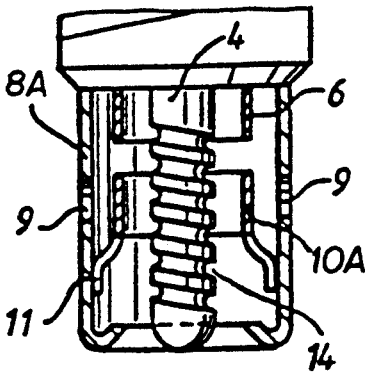
FIG. 2 schematically shows an embodiment of the lower part of the flame-type heater plug with an annular air deflector in the cylindrically designed flame tube.

According to FIG. 2, the free end of the flame tube 8A is drawn arcuately inwards, in order there to deflect the inflowed air or the fuel/air mixture onto the hot heating bar 4, thereby further improving the mixture formation and achieving a higher combustion.

Figure 5:
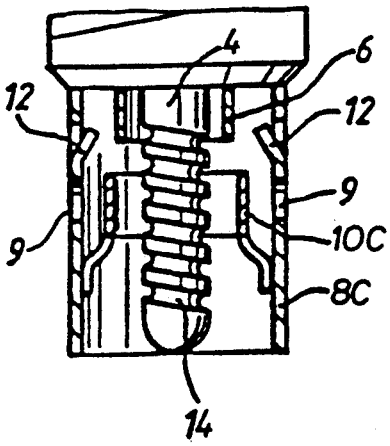
FIG. 5 shows an embodiment of a flame tube with indentations for the additional air inflow.

According to FIG. 5, gills 12 are provided on the flame tube 8C above the passage orifices 9, Which gills guide the inflowing air between the flame tube 8C and evaporator tube 6 and finally between the air deflector 10C and the heating bar 4, in order to ventilate the interior there. For this purpose, the air deflector 10C has a larger diameter than the evaporator tube 6.

As a result of the special designs of the air inlets and of the air deflector, the danger of sooting or coke deposits between the heating bar and evaporator tube is eliminated by means of the good ventilation.

Figure 6:
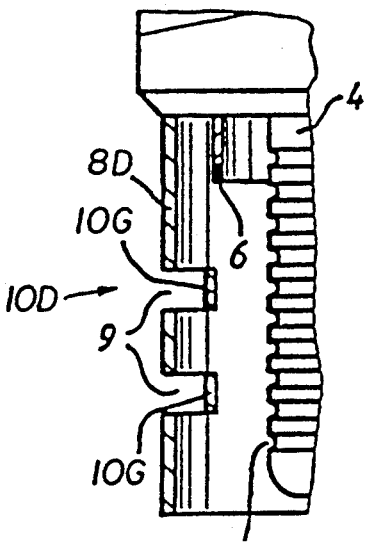
FIG. 6 shows another embodiment of the flame tube with a differently designed air deflector.

The part of the heating bar 4 projecting from the evaporator tube 6 can be made grooved, specifically in the form of mutually superposed annular grooves 13 according to FIG. 6 or of a helical annular groove 14 according to FIGS. 2, 3, 5, thereby affording an enlargement of the surface of the heating bar 4 with the result of an improvement in ignition.

Figure 7:
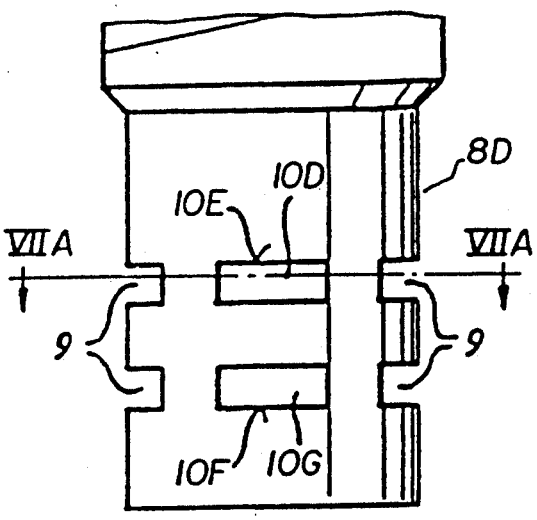
FIG. 7 shows the flame tube of FIG. 6 rotated through 90°.

FIGS. 6 and 7 show air deflectors 10D which are respectively formed relative to the flame tube 8D by two mutually superposed circumferentially extending slits 10E, 10F limiting an indented wall portion 10G. These air deflectors 10D are formed by wall portions which are pressed inwards out of the flame tube and the upper and lower limitations of which define the orifices. The air deflectors can be arranged in one row or two rows.

Figure 7A:
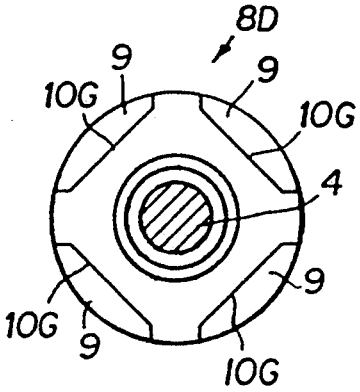
FIG. 7A is schematic sectional view along line VII-A-VIIA of FIG. 7.

FIG. 7A is schematic sectional view along line VII-A-VIIA of FIG. 7.

Figure 8:
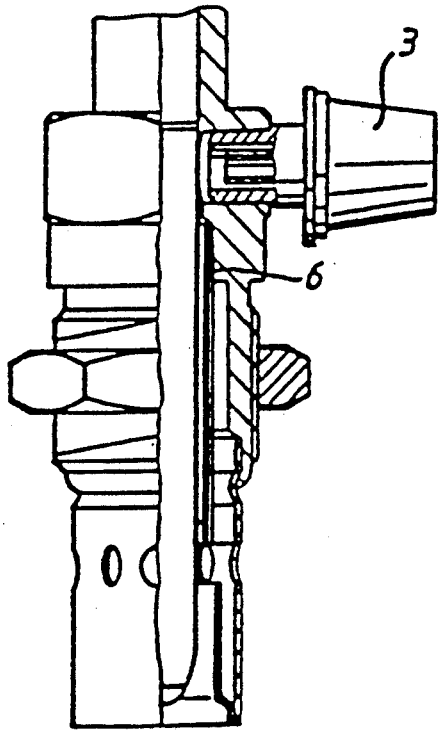
Fig. 8 PRIOR ART
FIG. 8 shows a known flame-type heater plug with an evaporator tube extending as far as the proportioning insert.

FIG. 8 illustrates a known flame-type heater plug in which the evaporator tube 6 is drawn up as far as the proportioning insert 3. Here, the fuel coming from the proportioning insert flows between the heating bar 4 and evaporator tube 6 into the flame tube 8. The fuel is in contact with the hot heating bar over only a small part. Soot accumulates, becomes coked with increasing thickness and at worst leads to the failure of the flame-type heater plug.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Flame-type heater plug for an air-compression fuel-injection internal-combustion engine, comprising:

a plug housing, a proportioning insert provided for the fuel supply and located on the plug housing, a heating bar having one end extending into and secured in the plug housing and having a free end extending outwardly of the plug housing, an evaporator tube arranged spaced along a substantial portion of the length of the plug housing from the proportioning insert and surrounding the heating bar to form an annular interspace therebetween with the free end of the heating bar projecting from the evaporator tube, a flame tube connected with the plug housing and disposed to surround the end of the evaporator tube from which the heating bar extends and to surround the portion of the heating bar extending therefrom, said flame tube adapted to be disposed in the flow path of intake air flowing in a suction tube of an internal-combustion engine when in an in-use position, said flame tube including passage orifices for passage of intake air into the interior of the flame tube, and a fuel connection in said plug housing between the proportioning insert and the evaporator tube, wherein said fuel connection includes a helical swirl channel opening into the annular interspace and located between the plug housing and the portion of the heating bar extending into the plug housing, wherein the swirl channel is formed on an outer surface of the heating bar.

2. Flame-type heater plug according to claim 1, wherein the heating bar is pressed into the part of the plug housing located above the evaporator tube.

3. Flame-type heater plug according to claim 1, wherein at least one air deflector is arranged between the heating bar and flame tube level with the passage orifices to prevent direct contact of the heating bar by air flowing through the passage orifices.

4. Flame-type heater plug according to claim 3, wherein the air deflector is fastened via webs to the part of the flame tube located below the passage orifices.

5. Flame-type heater according to claim 3, wherein the air deflector is formed by wall portions which are pressed inwards out of the flame tube and the upper and lower limitations of which define the orifices.

6. Flame-type heater according to claim 1, wherein the bar part of the heating bar projecting from the evaporator tube has mutually superposed annular grooves.

7. Flame-type heater according to claim 6, wherein the free end of the flame tube is drawn arcuately inwards for deflecting the fuel/air mixture onto the heating bar.

8. Flame-type heater according to claim 1, wherein the free end of the flame tube is drawn arcuately inwards for deflecting the fuel/air mixture onto the heating bar.

9. Flame-type heater plug according to claim 1, wherein the flame tube is equipped above its passage orifices with gills guiding the air into the space formed by the flame tube and evaporator tube.

10. Flame-type heater plug according to claim 1, wherein the flame tube is equipped above its passage orifices with gills guiding the air into the space formed by the flame tube and evaporator tube.

11. Flame-type heater according to claim 1, wherein the bar part of the heating bar projecting from the evaporator tube has a helical annular groove.

12. Flame-type heater according to claim 11, wherein the free end of the flame tube is drawn arcuately inwards for deflecting the fuel/air mixture onto the heating bar.

* * * * *